US012527403B1

(12) United States Patent
Xu

(10) Patent No.: US 12,527,403 B1
(45) Date of Patent: Jan. 20, 2026

(54) IRON-FRAMED MODULAR SEAT

(71) Applicant: Meifang Xu, Zhejiang (CN)

(72) Inventor: Meifang Xu, Zhejiang (CN)

( * ) Notice: Subject to any disclaimer, the term of this patent is extended or adjusted under 35 U.S.C. 154(b) by 0 days.

(21) Appl. No.: 19/098,286

(22) Filed: Apr. 2, 2025

(30) Foreign Application Priority Data

Mar. 18, 2025 (CN) ..... 202510320069.0

(51) Int. Cl.

| | |
|---|---|
| ***A47C 4/02*** | (2006.01) |
| ***A47C 1/024*** | (2006.01) |
| ***A47C 7/28*** | (2006.01) |
| ***A47C 7/35*** | (2006.01) |
| ***A47C 7/54*** | (2006.01) |
| ***A47C 7/70*** | (2006.01) |
| ***A47C 13/00*** | (2006.01) |

(52) U.S. Cl.
CPC ..... *A47C 4/028* (2013.01); *A47C 1/024* (2013.01); *A47C 7/285* (2013.01); *A47C 7/35* (2013.01); *A47C 7/546* (2013.01); *A47C 4/02* (2013.01); *A47C 7/70* (2013.01); *A47C 13/005* (2013.01)

(58) Field of Classification Search
CPC ..... A47C 4/02; A47C 4/028; A47C 7/285; A47C 7/70; A47C 13/005; A47C 7/35
See application file for complete search history.

(56) References Cited

U.S. PATENT DOCUMENTS

| | | | | |
|---|---|---|---|---|
| 4,209,198 A * | 6/1980 | Apple, Sr. | A47C 4/02 297/440.23 X |
| 4,603,906 A * | 8/1986 | Mathiesen | A47C 4/03 297/440.23 X |
| 11,406,192 B1 * | 8/2022 | Wu | A47C 7/42 |
| 11,707,138 B1 * | 7/2023 | Wu | A47C 7/546 5/12.1 |
| 2024/0292952 A1 * | 9/2024 | Sun | A47C 3/18 |

* cited by examiner

*Primary Examiner* — Rodney B White

(57) ABSTRACT

An iron-framed modular seat, comprising a modular seat cushion, W-shaped steel bars are welded to a circumference of the seat frame, a seat cushion cover is provided on an outer side of the seat frame; a plurality of first connecting interfaces are correspondingly provided on the seat frame and the back frame; a plurality of second connecting interfaces are correspondingly provided on the seat frame and the armrest frames; a bottom of the seat frame is detachably provided with a plurality of independent support legs, and a plurality of third connecting interfaces are correspondingly provided on the independent support legs and the seat frame. The W-shaped steel bars not only strengthen the structural strength of the seat frame, but also form a detachable connection with the seat cushion cover.

10 Claims, 12 Drawing Sheets

IRON-FRAMED MODULAR SEAT

TECHNICAL FIELD

The invention relates to the technical field of seats, in particular to an iron-framed modular seat.

BACKGROUND ART

Existing seats or sofas are made of wood, which are heavy and difficult to carry. In addition, due to their large size, the transportation cost after packing is high. The one-piece injection molding structure has limited structural strength, which affects the service life of the seat or sofa. In addition, if some parts of the seat are damaged, the integrated seat needs to be replaced as a whole, which is expensive.

Moreover, in existing seats, a Chinese invention patent (Publication No. CN221903009U) discloses a four-spring-structure sofa. It comprises a sofa body with armrests incorporating solid wood support boards. Two layers of ultra-soft sponge are attached to each solid wood support board, with multiple mini pocket springs embedded between the two sponge layers. The sofa back comprises a back cushion and a back frame structure, where the back cushion contains multiple independent pocket spring units (Type A), and the back frame is equipped with tension straps. The sofa seat cushion incorporates multiple independent pocket spring units (Type B) and sponge, while its bottom frame houses positioning cords and multiple serpentine springs. Both ends of the serpentine springs are secured to the seat cushion's bottom frame via spring clasps. This design employs spring structures tailored to different parts of the sofa (e.g., seat, back, armrests) based on usage frequency and load-bearing requirements, aiming to reduce production costs while enhancing durability and localized support through isolated, non-interfering spring systems.

However, the aforementioned design relies on wooden frames and laminated boards to achieve its structural framework, which is environmentally unfriendly due to the adhesive content in the laminated boards. The residual formaldehyde cannot be fully eliminated.

Additionally, to improve comfort, existing seats (e.g., sofas, lounge chairs, office chairs, and automotive seats) often incorporate elastic components (e.g., spring assemblies) into their frames for resilience and shock absorption. In such configurations, hooks attached to one end of the spring assembly are directly hung on horizontal tubes, while clasp plates connected to the other end are fixed to the tubes using staples. These connection methods result in unstable fittings: the unsecured hooks or clasp plates tend to vibrate and rub against the tubes during use, generating noise and discomfort. Furthermore, these connections are prone to detachment over time.

Another issue lies in the permanently fixed upholstery covers, which are cumbersome and time-consuming to remove or replace.

Lastly, standalone seats (e.g., single-seat sofas or chairs) often require accompanying side tables for users to place personal items. These side tables not only take up additional space but also increase configuration costs.

SUMMARY OF THE INVENTION

In order to solve the above problems, the purpose of the invention is to provide an iron-framed modular seat, in which the seat cushion, backrest and armrests are detachably connected in a modular manner, which is convenient for disassembly and assembly, can reduce the occupied space, is conducive to transportation, and reduces transportation costs; the seat cushion, backrest and armrests in the seat have a variety of styles to choose from, which can be easily assembled and maintained according to user needs; the frame made of steel pipes replaces wooden seats, which is relatively light and more environmentally friendly, and a storage space can be formed in the seat frame for placing components such as backrests and armrests, further improving the storage effect. In addition, the plastic square buckles can wrap around the steel pipes and tightly clamp on the plastic square buckles, effectively reducing the friction caused by shaking between the plastic square buckles and the beam, and reducing the occurrence of abnormal noise. At the same time, the two sides of the circular serpentine springs are connected to the hollow elliptical hole, and multiple circular serpentine springs are connected with a plastic-coated steel wire frame, which can improve the elastic effect of the cushion and make the seat more comfortable; the fabric cover can be detachably connected to each component, which is easy to disassemble and wash; the armrest is hinged with a table top, so that the armrest of the seat can replace the side table, reducing the configuration cost of other tableware.

In order to achieve the above purpose, the invention adopts the following technical solutions.

An iron-framed modular seat, comprising a modular seat cushion, replaceable modular armrests and a replaceable modular backrest which are detachably arranged on the modular seat cushion; wherein a seat frame of the modular seat cushion and a back frame of the modular backrest are made of steel pipes; the modular armrest is one of an iron frame armrest, a solid wood armrest and a soft-packed armrest, and the modular armrest comprises two armrest frames; when the modular armrest is an iron frame armrest or a soft-packed armrest, the armrest frame is made of a steel pipe, and a foldable table top is installed on at least one side of the armrest frame; when the modular armrest is a solid wood armrest, a rattan weave is installed on the armrest frame; the seat frame, the back frame and the table top of the modular seat are covered with indoor sponge; when the modular armrest is an iron frame armrest or a soft-packed armrest, an indoor sponge is provided on the armrest frame, and the indoor sponge can be removed and replaced with an external drainage sponge;

Steel bars with two spaced apart V-shaped notches are welded to a circumference of the seat frame, a seat cushion cover is provided on an outer side of the seat frame, and tie bars are provided on an inner wall of a circumference of the seat cushion cover and are detachably connected to the Steel bars with two spaced apart V-shaped notches; the back frame is installed on an upper rear end of the seat frame, and a plurality of first connecting interfaces are correspondingly provided on the seat frame and the back frame; the armrest frames are attached to both sides of the seat frame and the back frame, and a plurality of second connecting interfaces are correspondingly provided on the seat frame and the armrest frames; a lower end of the armrest frame is lower than a lower end of the seat frame, so that the armrest frames can be supported on the ground, or the lower end of the armrest frame is flush with the lower end of the seat frame, and a bottom of the seat frame is detachably provided with a plurality of independent support legs, and a plurality of third connecting interfaces are correspondingly provided on the independent support legs and the seat frame.

Preferably, the seat frame is a rectangular iron frame, and a storage space is formed inside the frame; the frame comprises two symmetrically side support iron frames, and two upper support iron pipes and two lower support iron pipes welded between the two side support iron frames; a mounting platform is welded to the upper support iron pipes and the side support iron frames at a rear side of an upper end of the seat frame; inclined steel pipes are welded to both sides of the side support iron frame, and third connection interfaces for connecting the independent support legs are provided on the inclined steel pipes and the side support iron frame; the first connecting interfaces, the second connecting interfaces and the third connecting interfaces on both sides of the seat frame are symmetrically arranged, and a variety of replaceable armrests and backrests can be installed; a connecting iron pipe is welded between the two side support iron frames on an upper inside of the seat frame, and the connecting iron pipe is arranged at the same level as the upper support iron pipe; a plurality of fixing holes for mounting plastic square buckles are symmetrically provided on a surface of the connecting iron pipe and the upper support iron pipe.

Preferably, an inner wall surface of the plastic square buckle is provided with a protrusion, and the protrusion extends into the fixing hole so that the plastic square buckle is clamped and fixed on the steel pipe; side ends of the plastic square buckle are provided with two elliptical blocks which are adapted to be provided with a female tenon and a male tenon radially locked therewith; the two elliptical blocks are clamped together to form a hollow elliptical hole, and circular serpentine springs are hung on the hollow elliptical holes on both sides for connecting the plastic square buckles on both sides; the plastic square buckle is locked on the seat frame by the cooperation of the protrusion and the fixing hole, which is suitable for preventing making a sound due to friction between the plastic square buckles and the seat frame when the circular serpentine springs move up and down repeatedly; a U-shaped connecting block is provided on a top of the plastic square buckle for being detachably snap-fit with the seat cushion cover.

Preferably, a plastic-coated steel wire frame is provided on a lower end surface of the plurality of circular serpentine springs for connecting the plurality of circular serpentine springs so that they are uniformly stressed as a whole and play a high rebound role.

Preferably, the plastic-coated steel wire frame comprises a PVC fixed frame strip and a PVC fixed straight strip which are tied and fixed to the plurality of circular serpentine springs via a fixing sleeve.

Preferably, an angle adjuster is provided between the back frame and the seat frame to adjust the inclination angle of the back frame, so that the modular backrest can be tilted and laid flat.

Preferably, a plurality of first connecting interfaces are provided at an upper end of the mounting platform; a bottom of the back frame is mounted on the mounting platform and is provided with a plurality of the first connection interfaces correspondingly, and the back frame is arranged at an upper end of a rear side of the seat frame; there are two angle adjusters symmetrically arranged on both sides of the mounting platform; the angle adjuster comprises a main body fixed on a side end of the mounting platform, and a seat frame connecting plate and a back frame connecting plate arranged on both sides of the main body; the seat frame connecting plate is fixed to the side end of the mounting platform and is locked with the main body, and the back frame connecting plate is fixed to a side end of the back frame and can be rotated relative to the main body to adjust the inclination angle of the back frame.

Preferably, the modular armrest can be disassembled and replaced into one of an iron frame armrest, a solid wood armrest and a soft-packed armrest through second connection interfaces on the seat frame; the iron frame armrest comprises an iron frame floor-mounted armrest and an iron semi-suspended armrest, wherein lower ends of the iron frame floor-mounted armrest and the soft-packed armrest are lower than the lower end of the iron frame seat frame, so that the iron frame armrest frame can be supported on the ground; lower ends of the iron semi-suspended armrest and the solid wood armrest are flush with the lower end of the iron frame seat frame, and the lower end of the iron frame seat frame is supported on the ground by a plurality of independent support legs;

when the modular armrest is an iron frame armrest or a soft-packed armrest, two vertical beams are longitudinally welded inside the armrest frame, which are hinged to the table top via hinges; the hinge comprises a short connecting section and a long connecting section which are hinged to each other, wherein one connecting section is fixed to the vertical beam, and the other connecting section is fixed to the table top; the short connecting section and the long connecting section are provided with U-shaped connecting grooves which are arranged opposite to each other and a short connecting section adapter frame is provided on an upper outer side of the long connecting section, and the two are connected to each other in a relatively rotatable manner via a first connecting pin;

limiting holes are longitudinally provided on both sides of the long connecting section; a second connecting pin is provided through a lower part of the short connecting section, and a third connecting pin is provided through the limiting holes on both sides; both ends of the second connecting pin and both ends of the third connecting pin are respectively connected with limiting pieces; when the short connecting section and the long connecting section rotate relative to each other, the limiting piece is driven to move, thereby pulling the third connecting pin to move longitudinally on the limiting hole; a locking piece is provided in a connecting groove of the long connecting section, which is configured to lock the third connection pin on the limiting hole when the short connecting section and the long connecting section are in a right-angle state.

Preferably, the locking piece comprises a U-shaped locking block, a fourth connecting pin and a torsion spring; the fourth connecting pin is provided through the long connecting section and the U-shaped locking block and is located outside the limiting hole; the torsion spring is sleeved on the fourth connecting pin, and the U-shaped locking block is located outside the torsion spring; torsion arms on both sides of the torsion spring abut against upper and lower sides of an inner wall of the U-shaped locking block; when the table top is flipped to a horizontal state, the third connecting pin moves to an upper part of the limiting hole, and an upper end of the U-shaped locking block can be supported on a lower end of the third connecting pin, so that the third connecting pin and the limiting piece are in a locked state;

an accommodating opening is provided on both ends of an outer end of the long connecting section that is matched with the second connecting pin; when the short connecting section is fixed on the vertical beam, an arc-shaped buffer groove is provided on the vertical beam, and the table top is flipped to a vertical state, and the U-shaped locking block corresponds to the arc-shaped buffer groove.

Preferably, the independent support leg comprises a support leg body and a connecting column formed at an upper end of the support leg body, and the connecting column is provided with a plurality of third connection interfaces;

alternatively, the independent support leg comprises a connecting piece and a support leg body welded below the connecting piece; the third connection interfaces on the seat frame are arranged at the bottom of the seat frame, and the connecting piece is provided with a plurality of third connection interfaces which are connected and fixed to the bottom of the seat frame;

the seat cushion cover on an outside of the seat frame is detachably tied to the Steel bars with two spaced apart V-shaped notches, the replaceable backrest cover is detachably arranged on the back frame via a zipper, and the replaceable armrest cover and table top cover are detachably arranged on the armrest frame and the table top via a zipper.

After adopting the above technical solutions, the invention has the following beneficial effects:

1. the seat cushion, backrest and armrests in the seat can be detachably connected in a modular manner, which is convenient for disassembly and assembly, can reduce the occupied space, facilitate transportation, and reduce transportation costs;
2. the seat cushion, backrest and armrests in the seat have a variety of styles to choose from, which can be easily assembled and maintained according to user needs;
3. the frame made of steel pipes replaces wooden seats, which is relatively light and more environmentally friendly, and a storage space can be formed in the seat frame for placing components such as backrests and armrests, further improving the storage effect;
4. the plastic square buckles can wrap around the steel pipes and tightly clamp on the plastic square buckles, effectively reducing the friction caused by shaking between the plastic square buckles and the beam, and reducing the occurrence of abnormal noise;
5. the two sides of the circular serpentine springs are connected to the hollow elliptical hole, and multiple circular serpentine springs are connected with a plastic-coated steel wire frame, which can improve the elastic effect of the cushion and make the seat more comfortable;
6. the armrest is hinged with a table top, so that the armrest of the seat can replace the side table, reducing the configuration cost of other tableware;
7. the fabric cover can be detachably connected to each component, which is easy to disassemble and wash.

SPECIFIC EMBODIMENT OF THE INVENTION

Figure 1:
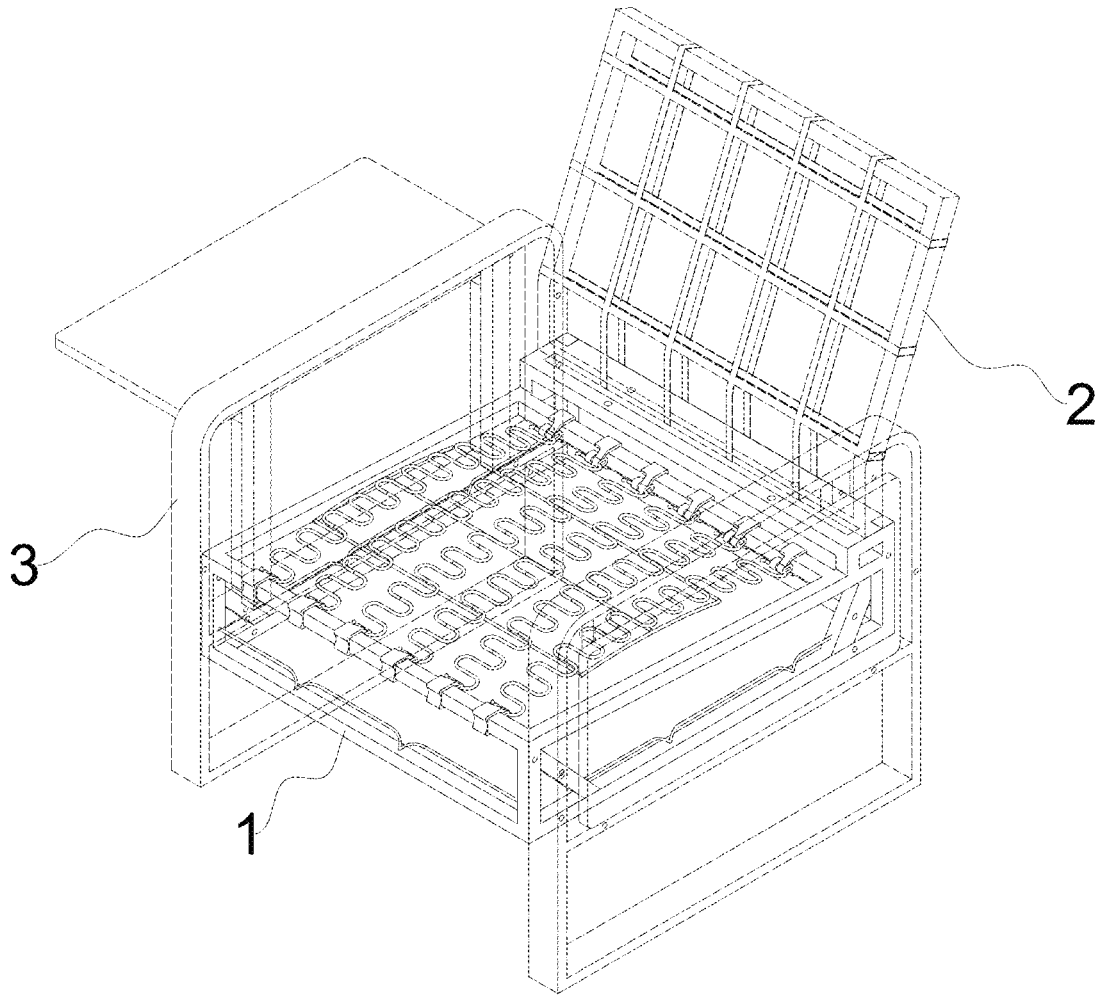
FIG. 1 is a schematic diagram of the three-dimensional structure of the first type of the iron-framed modular seat according to the invention.

The embodiments of the invention are described in detail hereinafter, and examples of the embodiments are shown in the accompanying drawings, wherein the same or similar reference numerals throughout represent the same or similar elements or elements having the same or similar functions. The embodiments described hereinafter with reference to the accompanying drawings are exemplary and are intended to be used to explain the invention, and should not be construed as limiting the invention.

In the description of the invention, it should be understood that the orientation or positional relationship indicated by the terms “center”, “longitudinal”, “transverse”, “length”, “width”, “thickness”, “upper”, “lower”, “front”, “back”, “left”, “right”, “vertical”, “horizontal”, “top”, “bottom”, “inner”, “outer”, “clockwise”, “counterclockwise” etc. are based on the orientation or positional relationship shown in the drawings, and is only for the convenience of describing the invention and simplifying the description, but not indicate or imply that the pointed device or element must have a specific orientation, be constructed and operated in a specific orientation, and therefore cannot be understood as a limitation of the invention.

In addition, the terms "first" and "second" are only used for descriptive purposes, and cannot be understood as indicating or implying relative importance or implicitly indicating the number of indicated technical features. Thus, the features defined with "first" and "second" may explicitly or implicitly include one or more of these features. In the description of the invention, unless otherwise clearly defined, "plurality" means two or more.

In the invention, unless otherwise clearly defined and limited, the terms "installed", "connected", "fixed" and other terms should be interpreted broadly; for example, it can be a fixed connection, a detachable connection or an integral connection; it can be a mechanical connection or an electrical connection; it can be a direct connection or an indirect connection through an intermediary, and it can be a connection between two components. For those of ordinary skill in the art, the specific meanings of the above terms in the invention can be understood according to specific circumstances.

In the invention, unless otherwise clearly defined and limited, the first feature is "above" or "below" the second feature can be that the first feature and the second feature are in direct contact, or the first feature and the second feature are not in direct contact but in contact with another feature between them. Moreover, the first feature is "above", "over", and "in the upper of" the second feature can be that the first feature is directly above and obliquely above the second feature, or only that the level of the first feature is higher than that of the second feature. The first feature is "below", "under", and "in the lower of" the second feature can be that the first feature is directly below and obliquely below the second feature, or only that the level of the first feature is lower than that of the second feature.

As shown in FIGS. 1-21, an iron-framed modular seat, comprising a modular seat cushion, replaceable modular armrests and a replaceable modular backrest which are detachably arranged on the modular seat cushion; wherein a seat frame 1 of the modular seat cushion and a back frame 2 of the modular backrest are made of steel pipes; the modular armrest is one of an iron frame armrest, a solid wood armrest and a soft-packed armrest, and the modular armrest comprises two armrest frames 3; when the modular armrest is an iron frame armrest or a soft-packed armrest, the armrest frame 3 is made of a steel pipe, and a foldable table top 4 is installed on at least one side of the armrest frame 3; when the modular armrest is a solid wood armrest, a rattan weave 5 is installed on the armrest frame 3; the seat frame 1, the back frame 2 and the table top 4 of the modular seat are covered with indoor sponge; when the modular armrest is an iron frame armrest or a soft-packed armrest, an indoor sponge is provided on the armrest frame 3, and the indoor sponge can be removed and replaced with an external drainage sponge;

the modular seat cushion is fixed with detachable and interchangeable modular armrests and detachable and interchangeable modular backrests that can be tilted and laid flat, or detachable and interchangeable support seat frames or detachable and interchangeable independent support legs. The modular armrests comprise all common modes such as iron frame armrests, solid wood armrests, and soft-packed armrests. A foldable bracket and a table top are installed on either side of the modular armrests. The fabric covers of various parts of the modular seat can be detached and interchanged. The indoor sponges installed on the seat frame, backrest, armrests, table top and other parts of the modular seat can be detached and interchanged with external drainage sponges and rattan.

Steel bars with two spaced apart V-shaped notches 6 are welded to a circumference of the seat frame 1, a seat cushion cover is provided on an outer side of the seat frame 1, and tie bars are provided on an inner wall of a circumference of the seat cushion cover and are detachably connected to the Steel bars with two spaced apart V-shaped notches 6; the back frame 2 is installed on an upper rear end of the seat frame 1, and a plurality of first connecting interfaces 7 are correspondingly provided on the seat frame 1 and the back frame 2; the armrest frames 3 are attached to both sides of the seat frame 1 and the back frame 2, and a plurality of second connecting interfaces 8 are correspondingly provided on the seat frame 1 and the armrest frames 3; a lower end of the armrest frame 3 is lower than a lower end of the seat frame 1, so that the armrest frames 3 can be supported on the ground, or the lower end of the armrest frame 3 is flush with the lower end of the seat frame 1, and a bottom of the seat frame 1 is detachably provided with a plurality of independent support legs 9, and a plurality of third connecting interfaces 10 are correspondingly provided on the independent support legs 9 and the seat frame 1.

In the above technical solutions, the Steel bars with two spaced apart V-shaped notches not only strengthen the structural strength of the seat frame, but also form a detachable connection with the seat cushion cover, which is convenient for disassembly, washing and replacement; the seat cushion, backrest and armrests in the seat can be detachably connected in a modular manner, which is convenient for disassembly and assembly, can reduce the occupied space, facilitate transportation, and reduce transportation costs; the seat cushion, backrest and armrests in the seat have a variety of styles to choose from, which can be easily assembled and maintained according to user needs.

Figure 2:
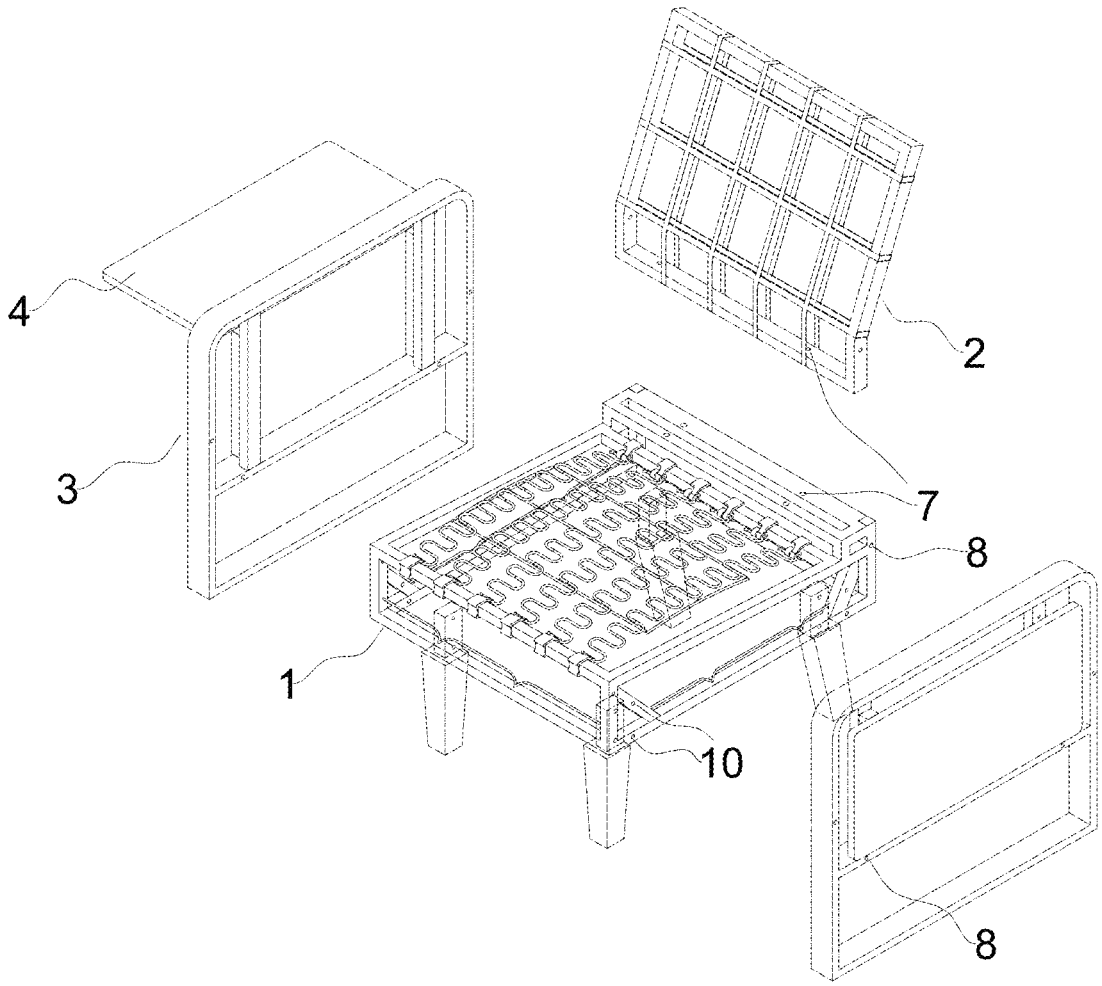
FIG. 2 is a schematic diagram of the exploded structure of the iron-framed modular seat according to the invention.
Figure 6:
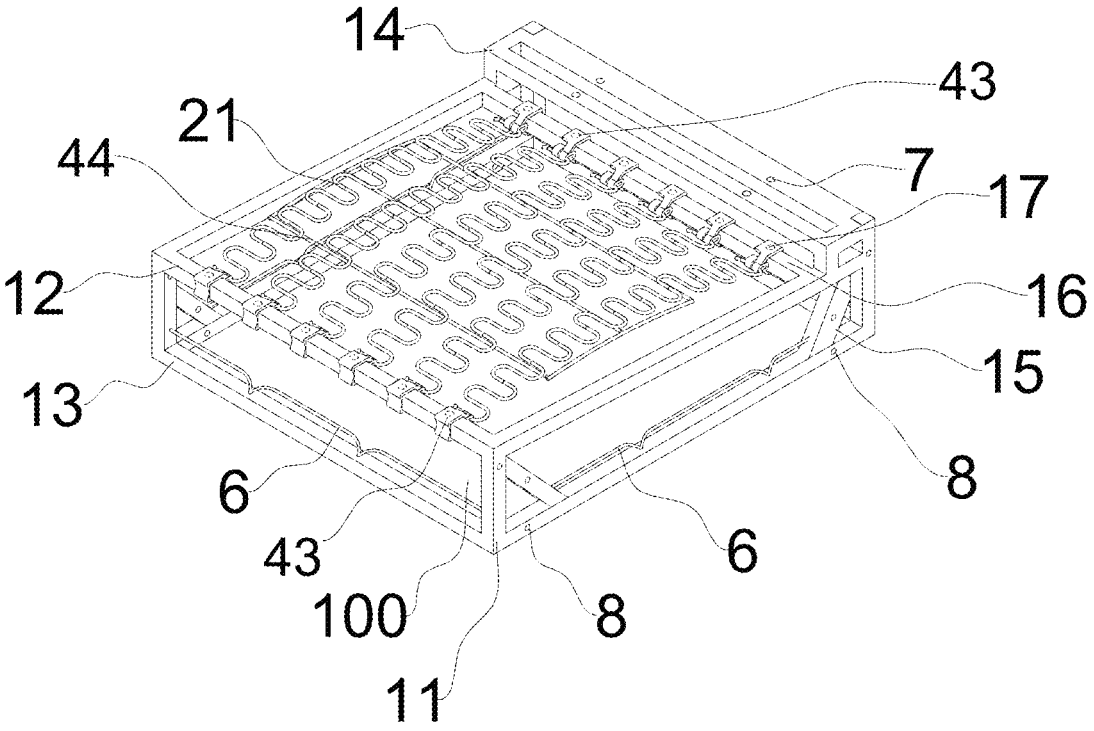
FIG. 6 is a schematic diagram of the three-dimensional structure of the seat frame according to the invention.
Figure 11:
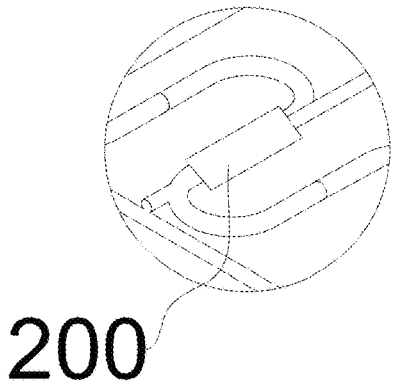
FIG. 11 is a schematic diagram of the bundling of the plastic-coated steel wire frame and the circular serpentine springs according to the invention.
Figure 12:
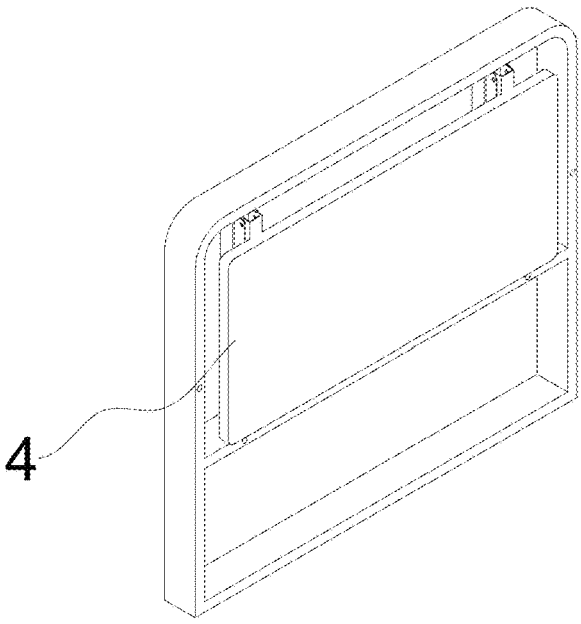
FIG. 12 is a schematic diagram of the three-dimensional structure of the iron frame floor-mounted armrest according to the invention.
Figure 13:
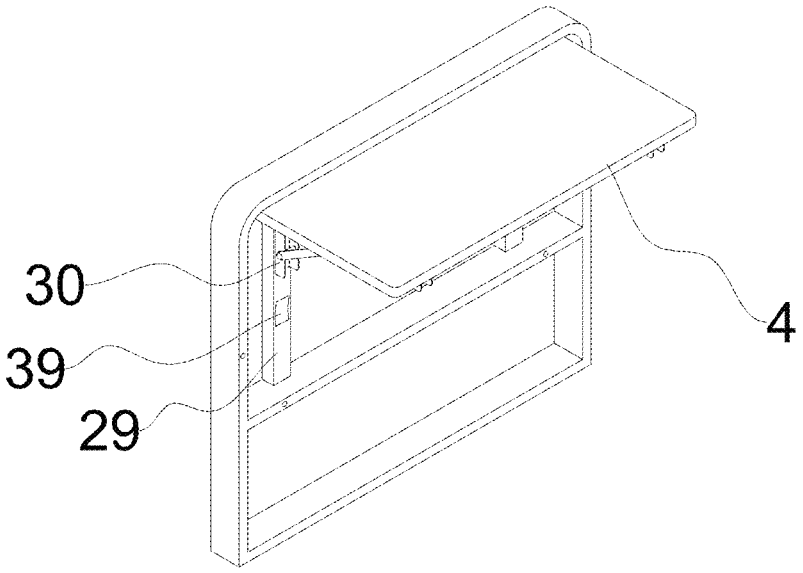
FIG. 13 is a schematic diagram of the iron frame floor-mounted armrest with the table top opened according to the invention.
Figure 14:
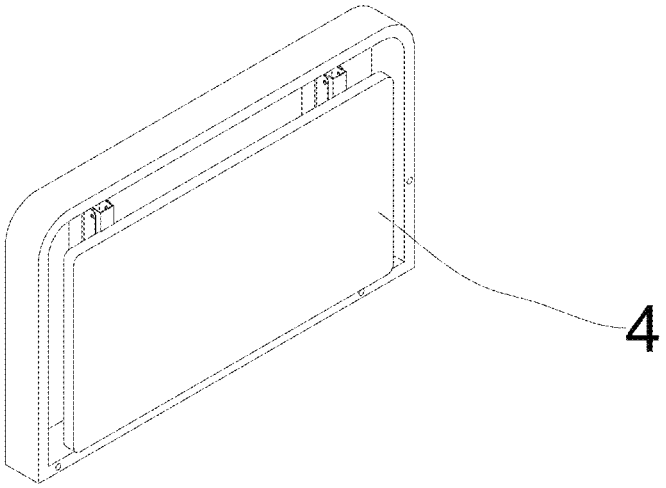
FIG. 14 is a schematic diagram of the three-dimensional structure of the iron semi-suspended armrest according to the invention.
Figure 15:
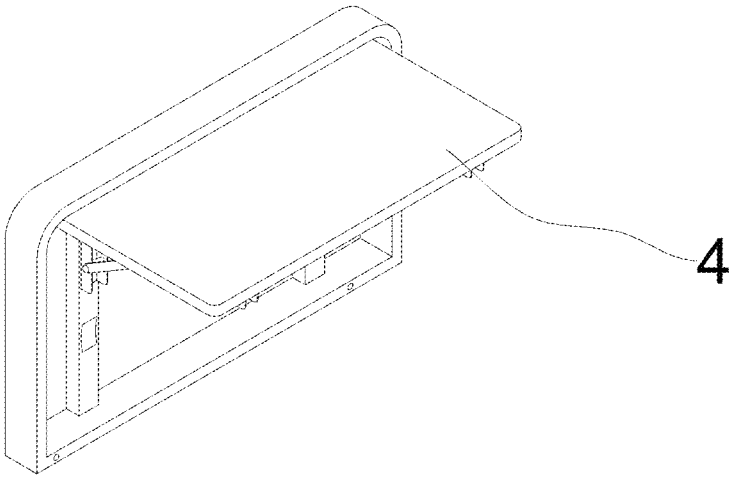
FIG. 15 is a schematic diagram of the iron semi-suspended armrest with the table top opened according to the invention.
Figure 16:
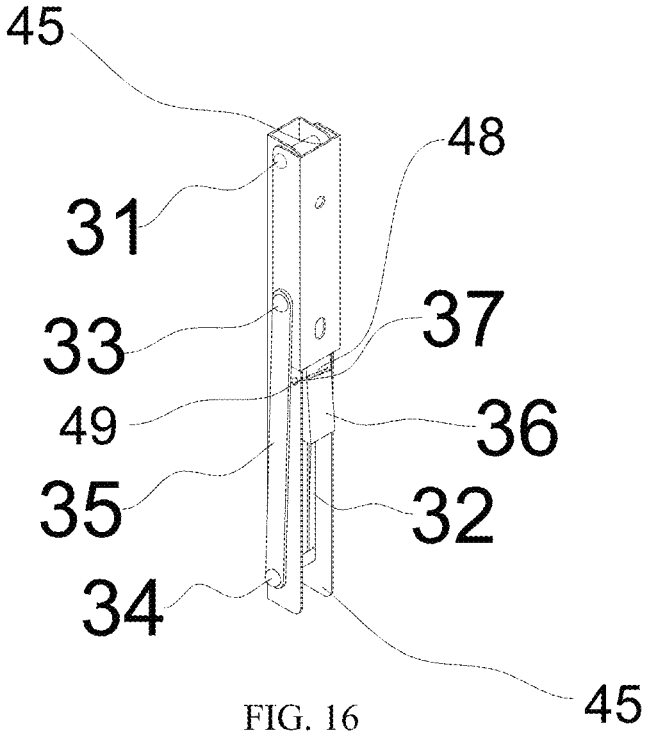
FIG. 16 is a schematic diagram of the three-dimensional structure of the hinge according to the invention.
Figure 17:
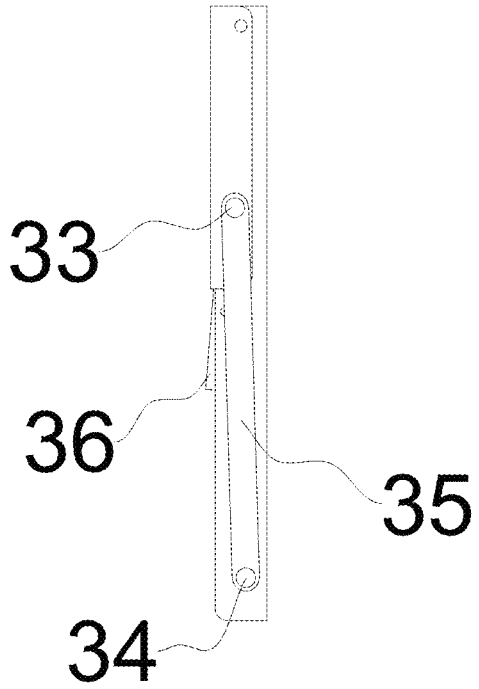
FIG. 17 is a schematic diagram of the side structure of the hinge according to the invention.
Figure 18:
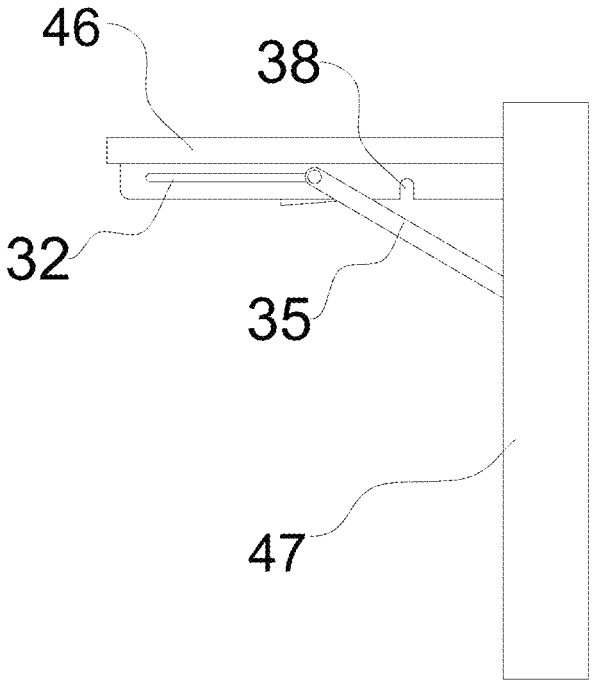
FIG. 18 is a schematic diagram showing the hinge being opened according to the invention.

As shown in FIGS. 2, 6, and 11, the seat frame 1 is a rectangular iron frame, and a storage space 100 is formed inside the frame; the frame comprises two symmetrically side support iron frames 11, and two upper support iron pipes 12 and two lower support iron pipes 13 welded between the two side support iron frames 11; a mounting platform 14 is welded to the upper support iron pipes 12 and the side support iron frames 11 at a rear side of an upper end of the seat frame 1; inclined steel pipes 15 are welded to both sides of the side support iron frame 11, and third connection interfaces 10 for connecting the independent support legs 9 are provided on the inclined steel pipes 15 and the side support iron frame 11; the first connecting interfaces 7, the second connecting interfaces 8 and the third connecting interfaces 10 on both sides of the seat frame 1 are symmetrically arranged, and a variety of replaceable armrests and backrests can be installed; a connecting iron pipe 16 is welded between the two side support iron frames 11 on an upper inside of the seat frame 1, and the connecting iron pipe 16 is arranged at the same level as the upper support iron pipe 12; a plurality of fixing holes for mounting plastic square buckles 17 are symmetrically provided on a surface of the connecting iron pipe 16 and the upper support iron pipe 12.

The seat frame fixes all the above interchangeable armrests and independent leg support seat frames. The four corners of the seat frame are welded with oblique steel pipes and have connection interfaces with holes for installing independent support legs. The seat frame comprises two symmetrically arranged side support iron frame armrests or can be replaced with independent support legs. The various armrests and backrests installed on both sides of the seat frame have unified assembly screw holes, and any styles of armrests and backrests can be interchanged. The four corners of the seat frame are welded with oblique steel pipes and provided with holes for installing independent support legs, which can be disassembled and interchanged with various styles of legs. In this solution, the oblique steel pipe not only improves the structural strength of the seat frame, but also facilitates the installation of the first type independent support legs.

As shown in FIGS. 8-11, an inner wall surface of the plastic square buckle 17 is provided with a protrusion 18, and the protrusion 18 extends into the fixing hole so that the plastic square buckle 17 is clamped and fixed on the steel pipe; side ends of the plastic square buckle 17 are provided with two elliptical blocks 19 which are adapted to be provided with a female tenon and a male tenon radially locked therewith; the two elliptical blocks 19 are clamped together to form a hollow elliptical hole 20, and circular serpentine springs 21 are hung on the hollow elliptical holes 20 on both sides for connecting the plastic square buckles 17 on both sides; the plastic square buckle 17 is locked on the seat frame 1 by the cooperation of the protrusion 18 and the fixing hole, which is suitable for preventing making a sound due to friction between the plastic square buckles 17 and the seat frame 1 when the circular serpentine springs 21 move up and down repeatedly; a U-shaped connecting block 22 is provided on a top of the plastic square buckle 17 for being detachably snap-fit with the seat cushion cover. A plastic-coated steel wire frame is provided on a lower end surface of the plurality of circular serpentine springs 21 for connecting the plurality of circular serpentine springs 21 so that they are uniformly stressed as a whole and play a high rebound role. The plastic-coated steel wire frame comprises a PVC fixed frame strip 23 and a PVC fixed straight strip 24 which are tied and fixed to the plurality of circular serpentine springs 21 via a fixing sleeve 200, as shown in FIG. 11. In the solution, the plastic square buckles can wrap around the steel pipes and tightly clamp on the plastic square buckles, effectively reducing the friction caused by shaking between the plastic square buckles and the beam, and reducing the occurrence of abnormal noise; the two sides of the circular serpentine springs are connected to the hollow elliptical hole, and multiple circular serpentine springs are connected with a plastic-coated steel wire frame, which can improve the elastic effect of the cushion and make the seat more comfortable.

The seat frame adopts plastic square buckles to connect the iron seat frame and fix it with the hollow elliptical circular serpentine springs on the side. The iron circular serpentine spring fixing hole cooperates with the protrusion of the circular serpentine springs, so that no friction and sound will be generated when the human body sits up and down repeatedly. The seat frame and the circular serpentine springs are grafted with plastic square buckles at both ends to achieve a more comfortable sitting feeling. The top U-shaped plastic square buckle is fixed by the seat cushion cover in a clip-on manner, and the cover can be removed. The elastic component comprises multiple circular serpentine springs. There are two plastic-coated steel wire frames on the upper and lower parts of the circular serpentine spring to fix it, so that the circular serpentine springs on the seat frame can be evenly borne as a whole, achieving a high rebound effect and never deforming.

Figure 3:
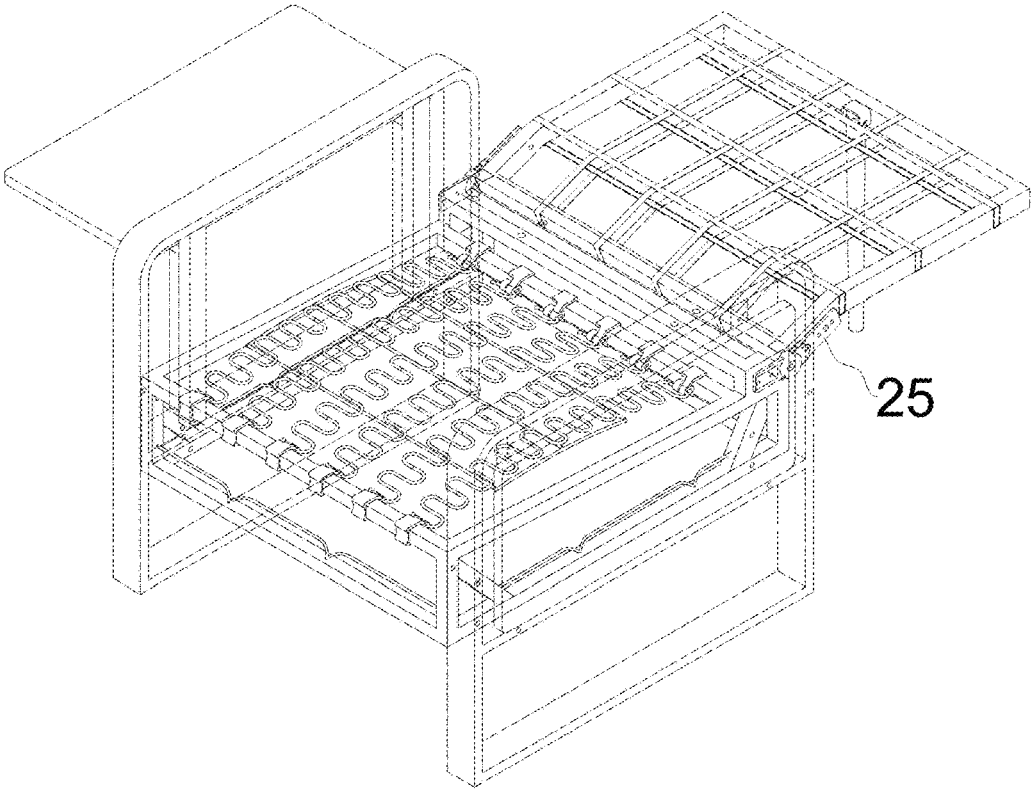
FIG. 3 is a schematic diagram of the iron-framed modular seat according to the invention in FIG. 1 when the backrest is lying down.
Figure 4:
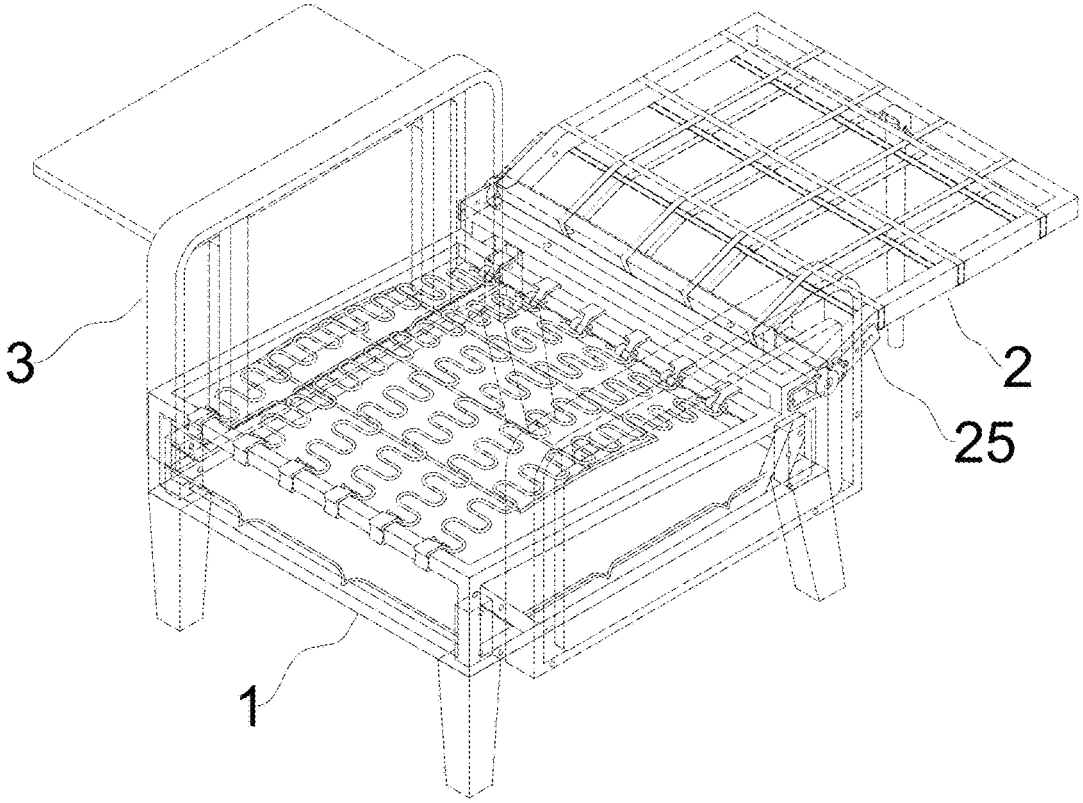
FIG. 4 is a schematic diagram of the second type of the iron-framed modular seat according to the invention when the backrest is lying down.
Figure 5:
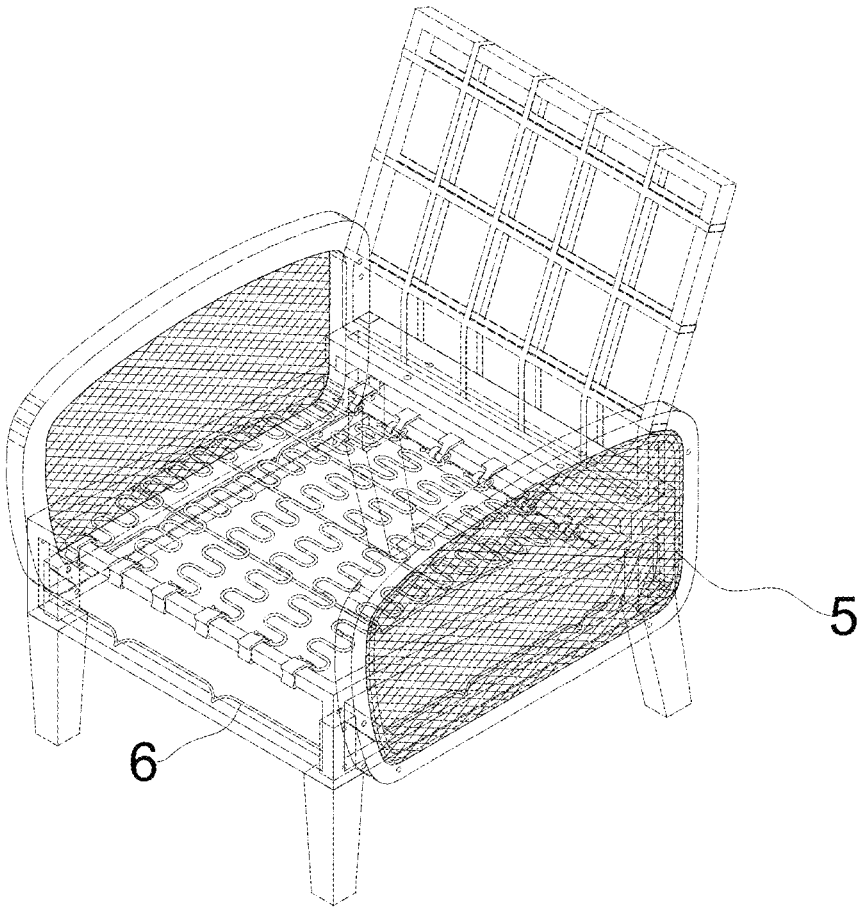
FIG. 5 is a schematic diagram of the three-dimensional structure of the third type of the iron-framed modular seat according to the invention.
Figure 7:
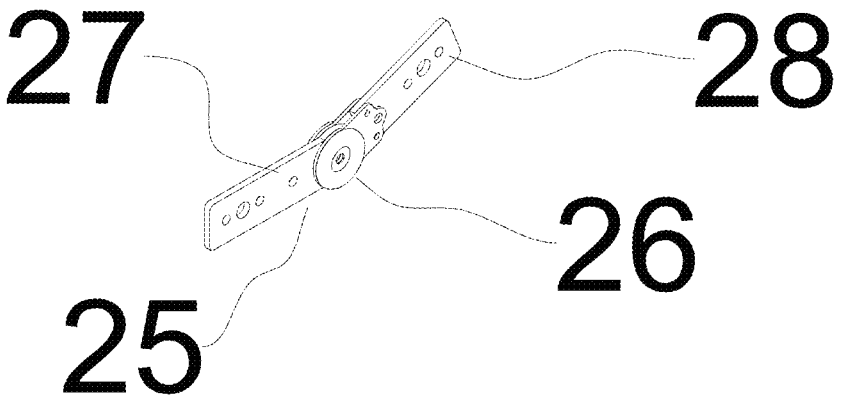
FIG. 7 is a schematic diagram of the three-dimensional structure of the angle adjuster according to the invention.
Figure 8:
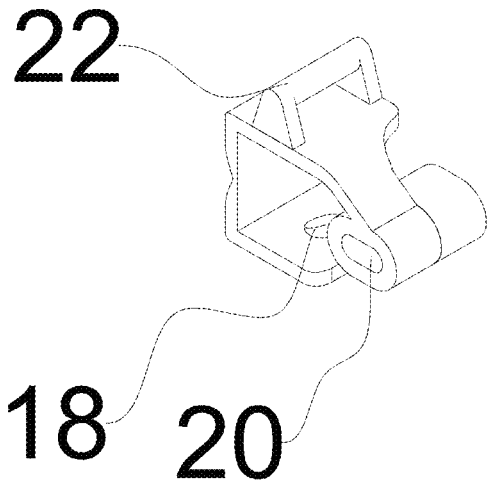
FIG. 8 is a schematic diagram of the three-dimensional structure of the plastic square buckle according to the invention.
Figure 9:
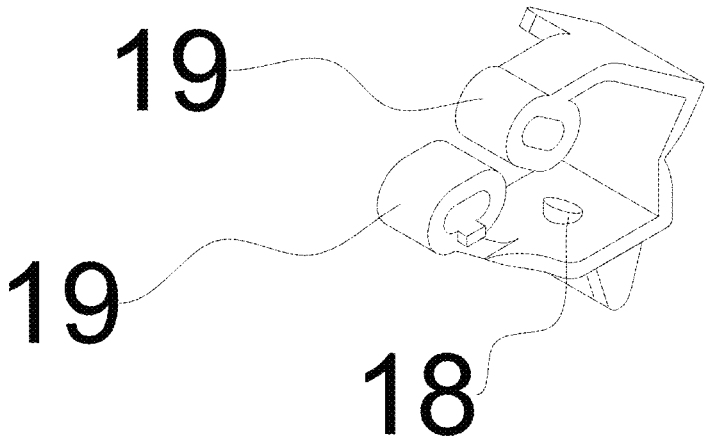
FIG. 9 is a schematic diagram of the three-dimensional structure of the plastic square buckle according to the invention from another perspective.
Figure 10:
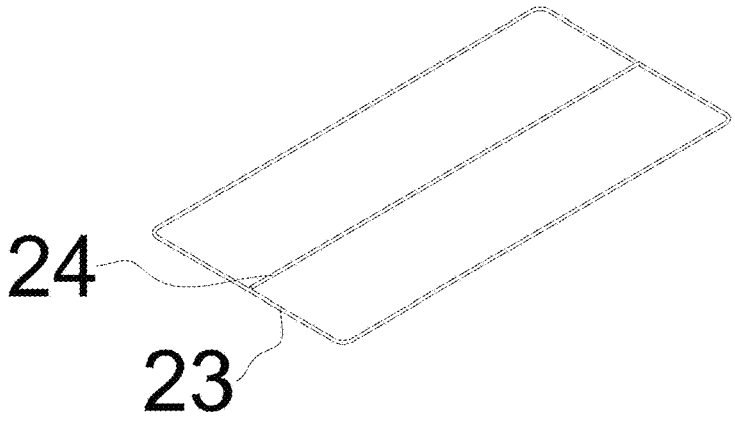
FIG. 10 is a schematic diagram of the three-dimensional structure of the plastic-coated steel wire frame according to the invention.

As shown in FIGS. 3, 4, and 7, an angle adjuster 25 is provided between the back frame 2 and the seat frame 1 to adjust the inclination angle of the back frame 2, so that the modular backrest can be tilted and laid flat. A plurality of first connecting interfaces 7 are provided at an upper end of the mounting platform 14; a bottom of the back frame 2 is mounted on the mounting platform 14 and is provided with a plurality of the first connection interfaces 7 correspondingly, and the back frame 2 is arranged at an upper end of a rear side of the seat frame 1; there are two angle adjusters 25 symmetrically arranged on both sides of the mounting platform 14; the angle adjuster 25 comprises a main body 26 fixed on a side end of the mounting platform 14, and a seat frame connecting plate 27 and a back frame connecting plate 28 arranged on both sides of the main body 26; the seat frame connecting plate 27 is fixed to the side end of the mounting platform 14 and is locked with the main body 26, and the back frame connecting plate 28 is fixed to a side end of the back frame 2 and can be rotated relative to the main body 26 to adjust the inclination angle of the back frame 2.

In the above technical solutions, the modular backrest can be adjusted to tilt and lay flat, the backrest can be fixed and the backrest can be adjusted to various inclination angles through the angle adjuster; a connecting iron pipe is welded on the inner side of the upper part of the seat frame between the two side support iron frames, the connecting iron pipe is arranged at the same level as the upper support iron pipe, and the backrest can be fixed and the backrest can be adjusted to various inclination angles and laid flat through the angle adjuster, and various styles of backrests can be disassembled and interchanged.

As shown in FIGS. 12-18 and 1, the modular armrest can be disassembled and replaced into one of an iron frame armrest, a solid wood armrest and a soft-packed armrest through second connection interfaces 8 on the seat frame 1; the iron frame armrest comprises an iron frame floor-mounted armrest and an iron semi-suspended armrest, wherein lower ends of the iron frame floor-mounted armrest and the soft-packed armrest are lower than the lower end of the iron frame seat frame, so that the iron frame armrest frame 3 can be supported on the ground; lower ends of the iron semi-suspended armrest and the solid wood armrest are flush with the lower end of the iron frame seat frame 1, and the lower end of the iron frame seat frame 1 is supported on the ground by a plurality of independent support legs 9;

when the modular armrest is an iron frame armrest or a soft-packed armrest, two vertical beams 29 are longitudinally welded inside the armrest frame 3, which are hinged to the table top 4 via hinges 30; the hinge 30 comprises a short connecting section and a long connecting section which are hinged to each other, wherein one connecting section is fixed to the vertical beam 29, and the other connecting section is fixed to the table top 4; the short connecting section and the long connecting section are provided with U-shaped connecting grooves which are arranged opposite to each other and a short connecting section adapter frame is provided on an upper outer side of the long connecting section, and the two are connected to each other in a relatively rotatable manner via a first connecting pin 31;

limiting holes 32 are longitudinally provided on both sides of the long connecting section; a second connecting pin 33 is provided through a lower part of the short connecting section, and a third connecting pin 34 is provided through the limiting holes 32 on both sides; both ends of the second connecting pin 33 and both ends of the third connecting pin 34 are respectively connected with limiting pieces 35; when the short connecting section and the long connecting section rotate relative to each other, the limiting piece 35 is driven to move, thereby pulling the third connecting pin 34 to move longitudinally on the limiting hole 32; a locking piece is provided in a connecting groove of the long connecting section, which is configured to lock the third connection pin 34 on the limiting hole 32 when the short connecting section and the long connecting section are in a right-angle state.

The locking piece comprises a U-shaped locking block 36, a fourth connecting pin 37 and a torsion spring; the fourth connecting pin 37 is provided through the long connecting section and the U-shaped locking block 36 and is located outside the limiting hole 32; the torsion spring is sleeved on the fourth connecting pin 37, and the U-shaped locking block 36 is located outside the torsion spring; torsion arms on both sides of the torsion spring abut against upper and lower sides of an inner wall of the U-shaped locking block 36; when the table top 4 is flipped to a horizontal state, the third connecting pin 34 moves to an upper part of the limiting hole 32, and an upper end of the U-shaped locking block 36 can be supported on a lower end of the third connecting pin 34, so that the third connecting pin 34 and the limiting piece 35 are in a locked state;

an accommodating opening 38 is provided on both ends of an outer end of the long connecting section that is matched with the second connecting pin 33; when the short connecting section is fixed on the vertical beam 29, an arc-shaped buffer groove 39 is provided on the vertical beam 29, and the table top 4 is flipped to a vertical state, and the U-shaped locking block 36 corresponds to the arc-shaped buffer groove 39.

In the above technical solutions, when the short connecting section and the long connecting section are relatively unfolded, the limiting piece is linked to drive the third connecting pin to move in the limiting hole. When the third connecting pin moves to a certain distance in the limiting hole, the third connecting pin can be locked by a locking piece, so that the table top remains in a horizontal state and items can be placed or used for office work. The locking piece comprises a U-shaped locking block 14, a fourth connecting pin 15 and a torsion spring. When the third connecting pin moves upward, the upper part of the U-shaped locking block is squeezed and moved to the upper end of the limiting hole. The U-shaped locking block is reset to support the lower end of the third connecting pin under the action of the torsion spring, so that the third connecting pin can be maintained at the upper end of the limiting hole, thereby making the limiting piece and the second connecting pin in a locked state, and the table top is stabilized in a horizontal state. The multiple hinges can improve the load-bearing capacity of the table top.

In the solution, the two hinges allow the table top to bear a load of about 50 KG, with a high load-bearing capacity that can meet daily use. When unlocking, just press the outside of the U-shaped locking block, the inner end of the U-shaped locking block will rise, the third connecting pin will fall, and the table top will reset. If the short connecting section is fixed on the vertical beam, the third connecting pin will move laterally in the limiting hole; if the long connecting section is fixed on the vertical beam, the third connecting pin will move longitudinally in the limiting hole. The accommodating opening allows the second connecting pin to be accommodated in the accommodating opening of the long connecting section when the long connecting section and the short connecting section are closed, so that the table top is closer to the armrests in the initial vertical state, which is more beautiful. In addition, the arc-shaped buffer groove reduces the abnormal noise caused by the collision between the U-shaped locking block and the vertical beam when the table top is flipped to the vertical state, thereby better protecting the U-shaped locking block.

Figure 19:
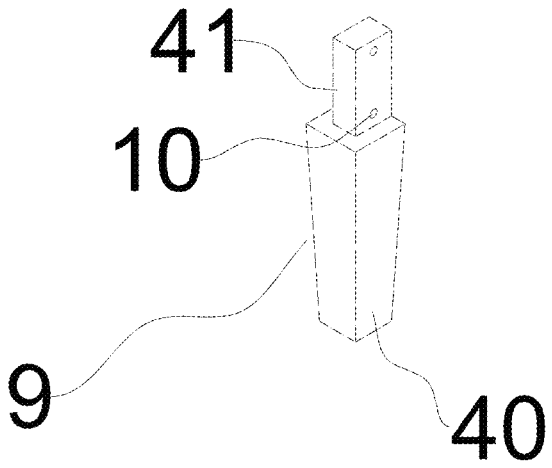
FIG. 19 is a schematic diagram of the three-dimensional structure of the first type of the independent support legs according to the invention.
Figure 20:
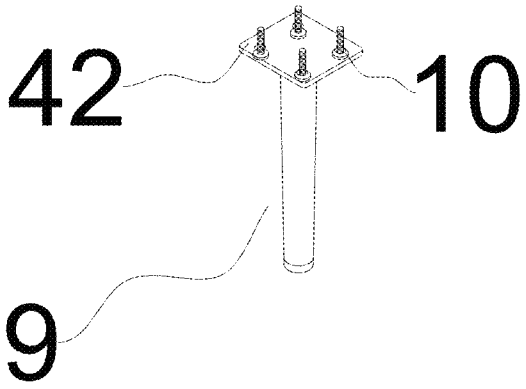
FIG. 20 is a schematic diagram of the three-dimensional structure of the second type of the independent support legs according to the invention.

As shown in FIGS. 19-20, the independent support leg 9 comprises a support leg body 40 and a connecting column 41 formed at an upper end of the support leg body 40, and the connecting column 41 is provided with a plurality of third connection interfaces 10; alternatively, the independent support leg 9 comprises a connecting piece 42 and a support leg body 40 welded below the connecting piece 42; the third connection interfaces 10 on the seat frame 1 are arranged at the bottom of the seat frame 1, and the connecting piece 42 is provided with a plurality of third connection interfaces 10 which are connected and fixed to the bottom of the seat frame 1. In the solution, the independent support legs are detachably connected, which is convenient for disassembly and assembly, and is easy for storage and transportation. It should be noted here that, as shown in the comparison between FIG. 1 and FIG. 2, FIG. 2 shows that the seat frame can be installed with the first type of independent support legs, and compared with FIG. 1, whether they are installed depends on the support effect required by the user.

The seat cushion cover on an outside of the seat frame 1 is detachably tied to the Steel bars with two spaced apart V-shaped notches 6, the replaceable backrest cover is detachably arranged on the back frame 2 via a zipper, and the replaceable armrest cover and table top 4 cover are detachably arranged on the armrest frame 3 and the table top 4 via a zipper.

Figure 21:
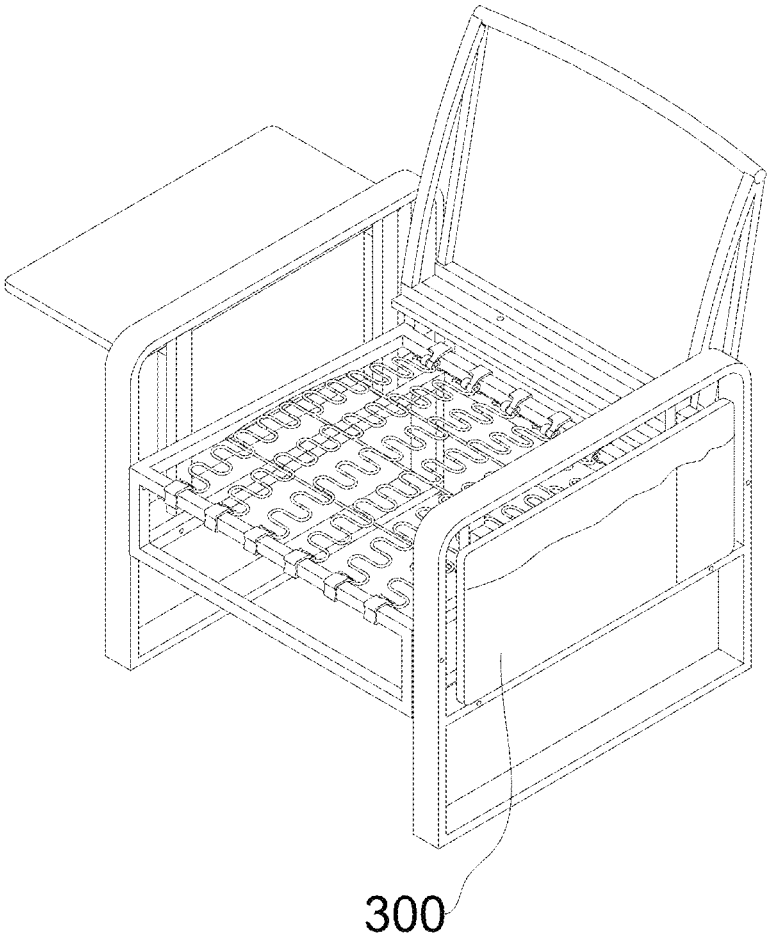
FIG. 21 is a schematic diagram of providing pockets on the table top according to the invention.

In FIG. 21, a plurality of pockets 300 are provided on an outer surface of the table top.

The combination of the armrest frame, seat frame, back frame and support legs illustrated in the embodiment does not represent all the combinations of the iron frame modular seat, and there are many other combinations.

In the embodiment, in view of the problems existing in the existing seats, the seat cushion, backrest and armrests in the seat can be detachably connected in a modular manner, which is convenient for disassembly and assembly, can reduce the occupied space, facilitate transportation, and reduce transportation costs; the seat cushion, backrest and armrests in the seat have a variety of styles to choose from, which can be easily assembled and maintained according to user needs; the frame made of steel pipes replaces wooden seats, which is relatively light and more environmentally friendly, and a storage space can be formed in the seat frame for placing components such as backrests and armrests, further improving the storage effect; the plastic square buckles can wrap around the steel pipes and tightly clamp on the plastic square buckles, effectively reducing the friction caused by shaking between the plastic square buckles and the beam, and reducing the occurrence of abnormal noise; the two sides of the circular serpentine springs are connected to the hollow elliptical hole, and multiple circular serpentine springs are connected with a plastic-coated steel wire frame, which can improve the elastic effect of the cushion and make the seat more comfortable; the armrest is hinged with a table top, so that the armrest of the seat can replace the side table, reducing the configuration cost of other tableware; the fabric cover can be detachably connected to each component, which is easy to disassemble and wash.

In the description of the specification, description with reference to the terms "one embodiment", "some embodiments", "examples", "specific examples", or "some examples" etc. means that the specific features, structures, materials, or characteristics described in conjunction with the embodiments or examples are included in at least one embodiment or example of the invention. In the specification, the schematic representation of the above terms does not necessarily refer to the same embodiment or example. Moreover, the described specific features, structures, materials or characteristics may be combined in any one or more embodiments or examples in a suitable manner.

Although the embodiments of the invention have been shown and described hereinabove, it can be understood that the above embodiments are illustrative and cannot be understood as limitations on the invention. Ordinary technicians in the field can change, replace and modify the above embodiments within the scope of the invention without departing from the principles and purpose of the invention.

The invention claimed is:

1. An iron-framed modular seat, comprising a modular seat cushion, replaceable modular armrests and a replaceable modular backrest which are detachably arranged on the modular seat cushion; wherein a seat frame of the modular seat cushion and a back frame of the modular backrest are made of steel pipes; the modular armrest is one of an iron frame armrest, a solid wood armrest and a soft-packed armrest, and the modular armrest comprises two armrest frames; when the modular armrest is an iron frame armrest or a soft-packed armrest, the armrest frame is made of a steel pipe, and a foldable table top is installed on at least one side of the armrest frame; when the modular armrest is a solid wood armrest, a rattan weave is installed on the armrest frame; the seat frame, the back frame and the table top of the modular seat are covered with indoor sponge; when the modular armrest is an iron frame armrest or a soft-packed armrest, an indoor sponge is provided on the armrest frame, and the indoor sponge can be removed and replaced with an external drainage sponge;

steel bars with two spaced apart V-shaped notches are welded to a circumference of the seat frame, a seat cushion cover is provided on an outer side of the seat frame; the back frame is installed on an upper rear end of the seat frame, and a plurality of first connecting interfaces are correspondingly provided on the seat frame and the back frame; the armrest frames are attached to both sides of the seat frame and the back frame, and a plurality of second connecting interfaces are correspondingly provided on the seat frame and the armrest frames; a lower end of the armrest frame is lower than a lower end of the seat frame, so that the armrest frames can be supported on the ground, or the lower end of the armrest frame is flush with the lower end of the seat frame, and a bottom of the seat frame is detachably provided with a plurality of independent support legs, and a plurality of third connecting interfaces are correspondingly provided on the independent support legs and the seat frame.

2. The iron-framed modular seat of claim 1, wherein the seat frame is a rectangular iron frame, and a storage space is formed inside the frame; the frame comprises two symmetrically side support iron frames, and two upper support iron pipes and two lower support iron pipes welded between the two side support iron frames; a mounting platform is welded to the upper support iron pipes and the side support iron frames at a rear side of an upper end of the seat frame; inclined steel pipes are welded to both sides of the side support iron frame, and third connection interfaces for connecting the independent support legs are provided on the inclined steel pipes and the side support iron frame; the first connecting interfaces, the second connecting interfaces and the third connecting interfaces on both sides of the seat frame are symmetrically arranged, and a variety of replaceable armrests and backrests can be installed; a connecting iron pipe is welded between the two side support iron frames on an upper inside of the seat frame, and the connecting iron pipe is arranged at the same level as the upper support iron pipe; a plurality of fixing holes for mounting plastic square buckles are symmetrically provided on a surface of the connecting iron pipe and the upper support iron pipe.

3. The iron-framed modular seat of claim 2, wherein an inner wall surface of the plastic square buckle is provided with a protrusion, and the protrusion extends into one of the fixing holes so that the plastic square buckle is clamped and fixed on the steel pipe; side ends of the plastic square buckle are provided with two elliptical blocks; the two elliptical blocks are clamped together to form a hollow elliptical hole, and circular serpentine springs are hung on the hollow elliptical holes on both sides for connecting the plastic square buckles on both sides; the plastic square buckle is locked on the seat frame by the cooperation of the protrusion and the fixing hole, which is suitable for preventing making a sound due to friction between the plastic square buckles and the seat frame when the circular serpentine springs move up and down repeatedly; a U-shaped connecting block is provided on a top of the plastic square buckle for being detachably snap-fit with the seat cushion cover.

4. The iron-framed modular seat of claim 3, wherein a plastic-coated steel wire frame is provided on a lower end surface of the plurality of circular serpentine springs for connecting the plurality of circular serpentine springs so that they are uniformly stressed as a whole and play a high rebound role.

5. The iron-framed modular seat of claim 4, wherein the plastic-coated steel wire frame comprises a PVC fixed frame strip and a PVC fixed straight strip which are tied and fixed to the plurality of circular serpentine springs via a fixing sleeve.

6. The iron-framed modular seat of claim 2, wherein an angle adjuster is provided between the back frame and the seat frame to adjust the inclination angle of the back frame, so that the modular backrest can be tilted and laid flat.

7. The iron-framed modular seat of claim 6, wherein the plurality of first connecting interfaces are provided at an upper end of the mounting platform; a bottom of the back frame is mounted on the mounting platform and is provided with a plurality of the first connection interfaces correspondingly, and the back frame is arranged at an upper end of a rear side of the seat frame; there are two angle adjusters symmetrically arranged on both sides of the mounting platform; the angle adjuster comprises a main body fixed on a side end of the mounting platform, and a seat frame connecting plate and a back frame connecting plate arranged on both sides of the main body; the seat frame connecting plate is fixed to the side end of the mounting platform and is locked with the main body, and the back frame connecting plate is fixed to a side end of the back frame and can be rotated relative to the main body to adjust the inclination angle of the back frame.

8. The iron-framed modular seat of claim 1, wherein the modular armrest can be disassembled and replaced into one of an iron frame armrest, a solid wood armrest and a soft-packed armrest through second connection interfaces on the seat frame; the iron frame armrest comprises an iron frame floor-mounted armrest and an iron semi-suspended armrest, wherein lower ends of the iron frame floor-mounted armrest and the soft-packed armrest are lower than the lower end of the iron frame seat frame, so that the iron frame armrest frame can be supported on the ground; lower ends of the iron semi-suspended armrest and the solid wood armrest are flush with the lower end of the iron frame seat frame, and the lower end of the iron frame seat frame is supported on the ground by a plurality of independent support legs;

when the modular armrest is an iron frame armrest or a soft-packed armrest, two vertical beams are longitudinally welded inside the armrest frame, which are hinged to the table top via hinges; the hinge comprises a short connecting section and a long connecting section which are hinged to each other, wherein one connecting section is fixed to the vertical beam, and the other connecting section is fixed to the table top; the short connecting section and the long connecting section are provided with a U-shaped connecting grooves respectively which are arranged opposite to each other and a short connecting section adapter frame is provided on an upper outer side of the long connecting section, and the two are connected to each other in a relatively rotatable manner via a first connecting pin;

limiting holes are longitudinally provided on both sides of the long connecting section; a second connecting pin is provided through a lower part of the short connecting section, and a third connecting pin is provided through the limiting holes on both sides; both ends of the second connecting pin and both ends of the third connecting pin are respectively connected with limiting pieces; when the short connecting section and the long connecting section rotate relative to each other, the limiting pieces are driven to move, thereby pulling the third connecting pin to move longitudinally on the limiting hole; a locking piece is provided in the U-shaped connecting groove of the long connecting section, which is configured to lock the third connection pin on the limiting hole when the short connecting section and the long connecting section are in a right-angle state.

9. The iron-framed modular seat of claim 8, wherein the locking piece comprises a U-shaped locking block, a fourth connecting pin and a torsion spring; the fourth connecting pin is provided through the long connecting section and the U-shaped locking block and is located outside the limiting hole; the torsion spring is sleeved on the fourth connecting pin, and the U-shaped locking block is located outside the torsion spring; torsion arms on both sides of the torsion spring abut against upper and lower sides of an inner wall of the U-shaped locking block; when the table top is flipped to a horizontal state, the third connecting pin moves to an upper part of the limiting hole, and an upper end of the U-shaped locking block can be supported on a lower end of the third connecting pin, so that the third connecting pin and the limiting piece are in a locked state;

an accommodating opening is provided on both ends of an outer end of the long connecting section that is matched with the second connecting pin; when the short connecting section is fixed on the vertical beam, an arc-shaped buffer groove is provided on the vertical beam, and the table top is flipped to a vertical state, and the U-shaped locking block corresponds to the arc-shaped buffer groove.

10. The iron-framed modular seat of claim 8, wherein each independent support leg comprises a support leg body and a connecting column formed at an upper end of the support leg body, and the connecting column is provided with a plurality of third connection interfaces;

alternatively, the independent support leg comprises a connecting piece and a support leg body welded below the connecting piece; the third connection interfaces on the seat frame are arranged at the bottom of the seat frame, and the connecting piece is provided with a plurality of third connection interfaces which are connected and fixed to the bottom of the seat frame;

the seat cushion cover on an outside of the seat frame is detachably tied to the steel bars with two spaced apart V-shaped notches, the replaceable backrest cover is detachably arranged on the back frame via a zipper, and the replaceable armrest cover and table top cover are detachably arranged on the armrest frame and the table top via a zipper.

* * * * *